US009279547B2

(12) United States Patent
Lacroix

(10) Patent No.: US 9,279,547 B2
(45) Date of Patent: Mar. 8, 2016

(54) LED-BASED DIRECT-VIEW LUMINAIRE WITH UNIFORM LIT APPEARANCE

(71) Applicant: KONINKLIJKE PHILIPS N.V., Eindhoven (NL)

(72) Inventor: Luc Guy Louis Lacroix, Burlington, MA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/371,867

(22) PCT Filed: Jan. 10, 2013

(86) PCT No.: PCT/IB2013/050222

§ 371 (c)(1),
(2) Date: Jul. 11, 2014

(87) PCT Pub. No.: WO2013/105046

PCT Pub. Date: Jul. 18, 2013

(65) Prior Publication Data

US 2015/0003055 A1 Jan. 1, 2015

Related U.S. Application Data

(60) Provisional application No. 61/586,156, filed on Jan. 13, 2012.

(51) Int. Cl.
*F21K 99/00* (2010.01)
*F21V 7/00* (2006.01)
(Continued)

(52) U.S. Cl.
CPC . *F21K 9/54* (2013.01); *F21V 5/046* (2013.01); *F21V 7/0025* (2013.01);
(Continued)

(58) Field of Classification Search
CPC ..... F21V 5/046; F21V 7/003; F21V 13/04; F21Y 2113/005; F21Y 2105/001; F21Y 2101/02
USPC ..... 362/231
See application file for complete search history.

(56) References Cited

U.S. PATENT DOCUMENTS 4,800,375 A * 1/1989 Silverstein et al. ..... 345/694
6,016,038 A 1/2000 Mueller
(Continued)

FOREIGN PATENT DOCUMENTS

JP 2005044661 A 2/2005
WO WO0107828 A1 2/2001
(Continued)

OTHER PUBLICATIONS

United States Patent Office Manual of Patent Examining Procedures, Section 2111.03 Transitional Phrases [R-08.2012], Mar. 2014, pp. 2100-2156 to 2100-2158.

*Primary Examiner* — Tracie Y Green
(74) *Attorney, Agent, or Firm* — Meenakshy Chakravorty

(57) ABSTRACT

Disclosed are methods and apparatus related to an LED-based luminaire (10) that redirects substantially all light output from LEDs (40) thereof off of an interior reflective surface at least once prior to the light exiting the LED-based luminaire (10). In some embodiments, an LED-based luminaire (10) is provided that includes a housing having a light output opening (20), a reflective interior surface, a diffusing cover lens (30) across the light output opening (20), and a plurality of optics (50) that are configured to redirect light output from a plurality of LEDs (40) within the lighting fixture (10).

20 Claims, 5 Drawing Sheets

(51) Int. Cl.

| | |
|---|---|
| ***F21V 5/04*** | (2006.01) |
| *F21V 13/04* | (2006.01) |
| *F21Y 101/02* | (2006.01) |
| *F21Y 105/00* | (2006.01) |
| *F21Y 113/00* | (2006.01) |

(52) U.S. Cl.

CPC ..... *F21V 7/0033* (2013.01); *F21V 13/04* (2013.01); *F21Y 2101/02* (2013.01); *F21Y 2105/001* (2013.01); *F21Y 2105/003* (2013.01); *F21Y 2113/005* (2013.01)

(56) References Cited

U.S. PATENT DOCUMENTS

| | | | | |
|---|---|---|---|---|
| 6,211,626 | B1 | 4/2001 | Lys | |
| 6,582,103 | B1 | 6/2003 | Popovich | |
| 6,974,229 | B2 | 12/2005 | West | |
| 7,220,039 | B2 * | 5/2007 | Ahn et al. | 362/612 |
| 2005/0001537 | A1 | 1/2005 | West | |
| 2006/0208267 | A1 | 9/2006 | Chin | |
| 2006/0291201 | A1 | 12/2006 | Smith | |
| 2006/0291205 | A1 | 12/2006 | Jeon | |
| 2007/0236937 | A1 | 10/2007 | Chao | |
| 2008/0073663 | A1 | 3/2008 | Chang | |
| 2008/0158881 | A1 | 7/2008 | Liu | |
| 2010/0232156 | A1 | 9/2010 | Tukker | |
| 2011/0096272 | A1 | 4/2011 | Han | |
| 2012/0002396 | A1 | 1/2012 | Tseng | |

FOREIGN PATENT DOCUMENTS

| | | | |
|---|---|---|---|
| WO | WO2007057834 | A1 | 5/2007 |
| WO | WO2008053415 | A2 | 5/2008 |
| WO | WO2008149250 | A1 | 12/2008 |

* cited by examiner

LED-BASED DIRECT-VIEW LUMINAIRE WITH UNIFORM LIT APPEARANCE

CROSS-REFERENCE TO PRIOR APPLICATIONS

This application is a U.S. national stage application under 35 U.S.C. §371 of International Application No. PCT/IB2013/050222, filed on Jan. 10, 2013, which claims priority benefit under 35 U.S.C. §119(e) of U.S. Provisional Application No. 61/586,156 filed on Jan. 13, 2012, the contents of which are herein incorporated by reference.

TECHNICAL FIELD

The present invention is directed generally to apparatus and methods of providing mixed light by LED light sources. More particularly, various inventive methods and apparatus disclosed herein relate to the generation of light that is substantially uniform in brightness and color from a color-mixing LED-based direct-view luminaire.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

Lighting fixtures (or "luminaires") employing a plurality LEDs often have one or more localized bright spots (e.g., localized areas of significantly increased luminance) that are noticeable due to the point source nature of LEDs. For example, LED-based direct-view lighting fixtures implementing LEDs often contain several visible localized bright spots corresponding to the location of the LEDs of the lighting fixture. Also, multi-channel lighting fixtures implementing multiple colors of LEDs of a variety of colors often have one or more localized color spots (e.g., localized areas of visibly different colors) due to the different colors of the LEDs. For example, direct view multi-channel lighting fixtures implementing LEDs often contain several visible localized color spots corresponding to the locations of the various colors of LEDs. These bright spots and/or color spots may provide an undesirable aesthetic appearance when a lighting fixture is directly viewable and/or may provide undesirable lighting characteristics at a location illuminated by a lighting fixture.

Thus, for many LED-based luminaires capable of producing light at particular color points and color temperatures, it is desirable to appropriately mix the light output of such LEDs prior to the light output exiting the LED-based lighting fixture. Appropriate mixing of the LEDs may reduce the presence of any undesired chromatic non-uniformity in the light output of the lighting fixture and provide more desirable light output characteristics. In implementing mixing solutions, many lighting fixtures employ multiple large mixing chambers and/or only provide illumination from a single planar light exit opening. Such configurations may result in an undesirably large mixing solution and/or a mixing solution of limited utility.

Also, various techniques developed for mixing light from LED light sources in the far field, i.e., illuminating a distant surface with light having uniform brightness or color, do not satisfactorily address the color mixing, uniformity, or lit appearance of a direct-view luminaire. Specifically, one important characteristic of a direct-view luminaire is the uniform appearance of the surface that emits light. A uniform appearance is one in which there are no bright or dark areas or color variations in the light, such as greenish or pinkish spots. Preferably, an observer should not be able to distinguish individual light sources (or rows thereof) or discern individual colors (e.g., red, green, or blue) simply by looking at the luminaire.

Color uniformity is important because architects and lighting designers go to great lengths to obscure individual bright spots and color variations on luminaires for aesthetic appeal. For example, fixtures may be installed within a recess (or at a further distance from a wall) to hide scalloping effects and direct glare. The value of a product that creates uniform color on a wall is greatly diminished when the luminaire exhibits prominent color or brightness non-uniformities that have to be hidden using other techniques.

The discrete nature of color LED light sources used in luminaires makes it more difficult to provide a uniform brightness and color for direct-view LED-based luminaires.

Thus, there is a need in the art to provide an LED-based direct-view luminaire producing satisfactory mixing of light output from a plurality of LEDs, such that its light-emitting surface appears substantially uniform in brightness and color, and that may optionally overcome one or more drawbacks with existing mixing solutions.

SUMMARY

The present disclosure is directed to inventive methods and apparatus for producing mixed light in a direct-view LED-based luminaire that is substantially uniform in brightness and color. Applicants have recognized and appreciated that the uniformity of the light-emitting surface of a direct-view luminaire can be improved by redirecting substantially all light output from LEDs thereof off of an interior reflective surface at least once prior to the light exiting the LED-based luminaire For example, in some embodiments, an LED-based luminaire is provided that includes a housing having a light output opening, a reflective interior surface, a diffusing cover lens across the light output opening, and a plurality of optics that are configured to redirect light output from a plurality of LEDs within the lighting fixture to the reflective interior surface that would otherwise be directly incident on the diffusing cover lens.

Generally, in one aspect, an LED-based luminaire is provided that includes a housing having a light output opening, a LED support area facing the light output opening, and a plurality of diffusely reflective walls extending between the LED support area and the light output opening. The lighting fixture also includes a plurality of LEDs adjacent the LED support area, a plurality of blocking optics each provided over a single of the LEDs, and a diffusing cover lens provided across the light output opening. Each of the LEDs selectively generates a LED light output having a component emitting directly toward the light output opening. Each of the blocking optics redirects at least the component of the LED light output of the single of LEDs toward at least one of the diffusely reflective walls.

In some embodiments, the diffusely reflective walls are rectangularly arranged.

In some embodiments, the LED support area is planar. In some versions of those embodiments the diffusely reflective walls are rectangularly arranged.

In some embodiments, the diffusing cover lens is provided atop the diffusely reflective walls. Also, the LED support area may include a plurality of openings receiving the LEDs therethrough and/or may be diffusely reflective.

In some embodiments, the blocking optics include side emitting optics.

Generally, in another aspect, an LED-based luminaire is provided that includes a housing having a LED support area, a diffusely reflective interior surface extending upward from and surrounding the LED support area, and a light output opening. The LED-based luminaire also includes a plurality of LEDs adjacent the LED support area. The LEDs include LEDs of a first color and LEDs of a second color and selectively generate a LED light output having a component emitting directly toward the light output opening. The LED-based luminaire also includes a plurality of blocking optics provided over the LEDs and redirecting at least the component of the LED light output of the LEDs toward the diffusely reflective interior surface. The LED-based luminaire also includes a diffusing cover lens provided across the light output opening.

In some embodiments, the diffusely reflective interior surface includes a plurality of rectangularly arranged walls. In some versions of those embodiments the LED support area is planar. In some versions of those embodiments the LED support area is provided at a base of the diffusely reflective interior surface.

In some embodiments, the blocking optics include at least one individual optic provided over a single of the LEDs.

In some embodiments, the diffusing cover lens is provided atop the diffusely reflective interior surface.

In some embodiments, the LEDs include LEDs of a third color and LEDs of a fourth color.

In some embodiments, the LEDs are provided in at least a first longitudinally extending row and a neighboring second longitudinally extending row. In some versions of those embodiments the LEDs in the first longitudinally extending row are positionally offset from the LEDs of the second longitudinally extending row in a direction along the length of the rows.

Generally, in another aspect, a method of achieving a uniform lit appearance in an LED-based lighting fixture is provided and includes the steps of: redirecting substantially all direct view light output from a plurality of LEDs toward a diffusely reflective interior surface surrounding the LEDs, wherein the direct view light output is light output of the LEDs that is emitted directly toward a diffusing lens; diffusely reflecting substantially all of the light output from the LEDs at the diffusely reflective interior surface; and transmitting the light output through the diffusing lens after diffusely reflecting substantially all of the light output from the LEDs at the interior surfaces.

In some embodiments, the LEDs are multi-channel LEDs.

In some embodiments, the method further includes the step of installing the lighting fixture so that the diffusing lens is directly viewable.

In some embodiments, the step of redirecting substantially all direct view light output from a plurality of LEDs toward a diffusely reflective interior surface surrounding the LEDs includes redirecting substantially all direct view light output from a single of the LEDs toward all of a plurality of diffusely reflective interior surfaces of the diffusely reflective interior surface.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The terms "lighting fixture" and "luminaire" are used interchangeably herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "direct-view luminaire" is used herein generally to describe various lighting fixtures in which the light emitted from the lighting fixture exits the fixture at a location directly viewable by an observer. A direct-view luminaire can include one or more light-emitting surfaces located such that at least a portion of the light emitting surface is directly viewable by the observer. It should be appreciated that light sources included in a direct-view luminaire may be blocked from direct view.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Lighting fixtures implementing LEDs often have one or more localized bright spots that are noticeable due to the point source nature of LEDs and/or one or more localized color spots due to the different colors of LEDs (when LEDs of different colors are provided). These bright spots and/or color spots may provide an undesirable aesthetic appearance when a lighting fixture is directly viewable and/or may provide undesirable lighting characteristics at a location illuminated by a lighting fixture. Thus, there is a need in the art to provide an LED-based luminaire that mixes light output from a plurality of LEDs to achieve a lit appearance that is uniform in luminance and/or color.

In view of the foregoing, various embodiments and implementations of the present invention are directed to an LED-based luminaire.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatus and methods may be omitted so as to not obscure the description of the representative embodiments. Such methods and apparatus are clearly within the scope of the claimed invention. For example, aspects of the methods and apparatus disclosed herein are illustrated in conjunction with a lighting fixture having a particular generally rectangular housing. However, one or more aspects of the methods and apparatus described herein may optionally be implemented in other housing configurations such as, for example, housings having a differing number of interior surfaces, housings having one or more non-planar surfaces, housings having an alternative light output opening, and/or housings having a different overall shape. Implementation of one or more aspects of an LED-based luminaire described herein with alternatively configured housings is contemplated without deviating from the scope or spirit of the claimed invention.

Figure 1:
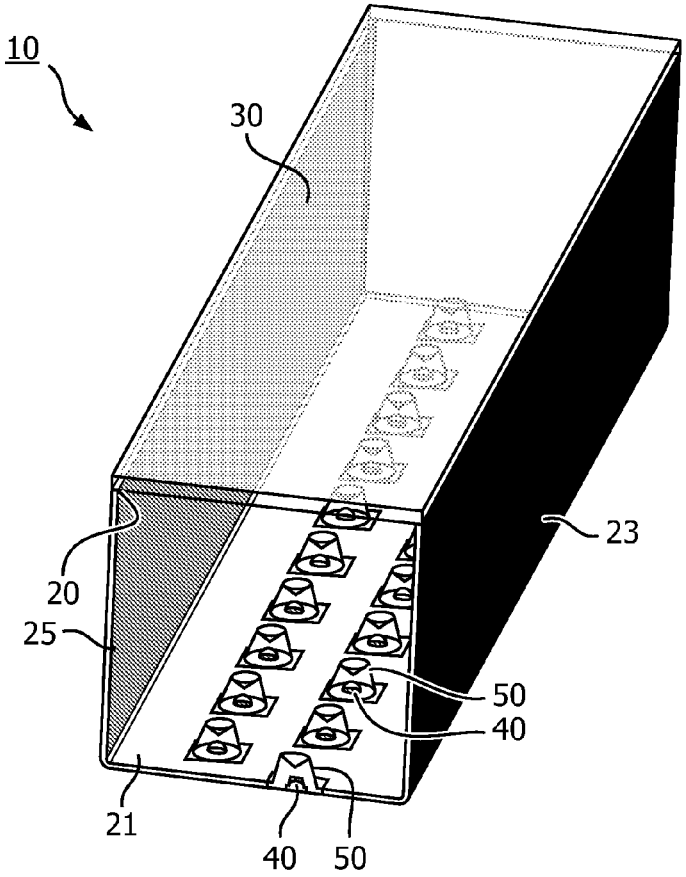
FIG. 1 illustrates a perspective section view of an embodiment of an LED-based luminaire that mixes light output from a plurality of LEDs to achieve a uniform lit appearance.
Figure 2:
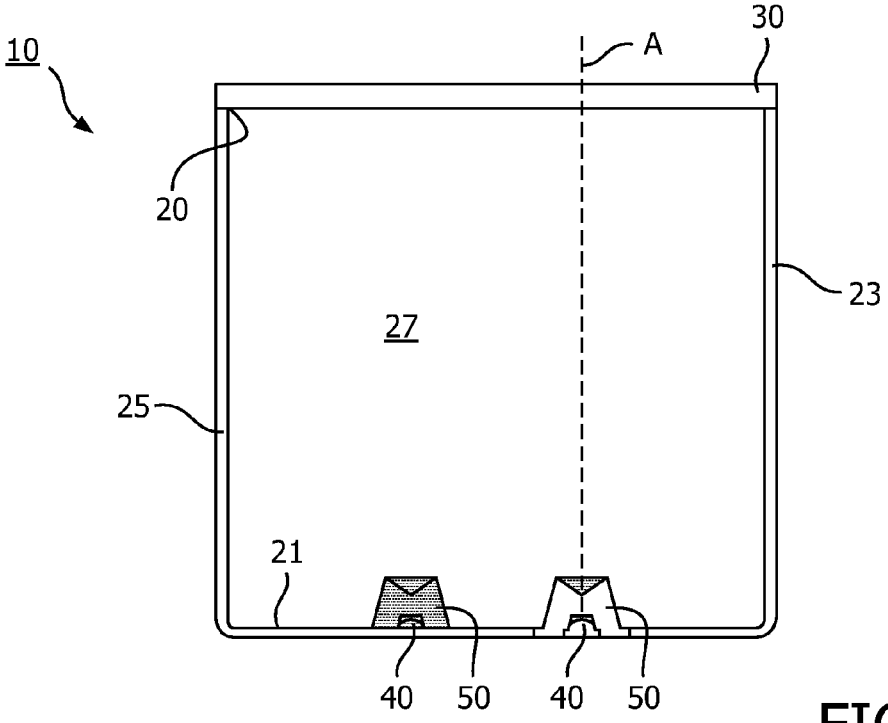
FIG. 2 illustrates a front section view of the LED-based luminaire of FIG. 1.

Referring to FIGS. 1-7, various aspects of an embodiment of an LED-based luminaire 10 that mixes light output from a plurality of LEDs to achieve a uniform lit appearance are illustrated. Referring initially to FIGS. 1 and 2, two views of an embodiment of the LED-based luminaire 10 are provided. FIG. 1 illustrates a perspective section view of the LED-based luminaire 10 and FIG. 2 illustrates a front section view of the LED-based luminaire 10. The LED-based luminaire 10 includes a housing having a plurality of walls 23, 25, 27, and 29 (illustrated in FIG. 5 but not in the section views of FIGS. 1 and 2) that extend upwardly from a LED support area 21. In some embodiments the walls 23, 25, 27, and 29 and the LED support area 21 may optionally be cohesively formed.

The LED support area 21 supports a plurality of LEDs 40 and corresponding individual optics 50 that are each provided over a single of the LEDs 40. As illustrated in the sectioned through LED 40 and optic 50 of FIGS. 1 and 2, the LEDs 40 and optics 50 extend through a plurality of openings provided through the LED support area 21. The LEDs 40 and/or optics 50 may optionally be coupled to a separate surface provided on an exterior side of the LED support area 21. For example, in some embodiments the LEDs 40 may be coupled to one or more LED printed circuit boards (PCBs) provided on an exterior side of the LED support area 21 and the optics 50 may also be coupled to the LED PCB(s). Also, for example, in some embodiments the LEDs 40 may be coupled to one or more LED PCBs provided on an exterior side of the LED support area 21 and the optics 50 may be coupled to the LED support area 21 proximal to respective of the openings provided through the LED support area 21. Also, for example, in some embodiments the LEDs 50 may be coupled directly or indirectly to a heatsink provided on an exterior side of the LED support area 21. In alternative embodiments one or more of the LEDs 40 and/or optics 50 may be mounted wholly atop the LED support area 21 and not extend through openings of the LED support area 21. For example, in some embodiments the LEDs 40 may be provided on one or more LED PCBs mounted atop the LED support area 21 on an interior side thereof and the optics 50 may also optionally be mounted atop the LED PCBs. One of ordinary skill in the art, having had the benefit of the present disclosure, will recognize and appreciate that other configurations of supporting and interfacing with LEDs to enable light output from the LEDs to enter the interior of the housing of the lighting fixture 10 may be provided.

The LEDs 40 and optics 50 are arranged in two longitudinally extending rows along the LED support area 21. The LEDs 40 of one row are positionally offset from the LEDs of the other row in a direction along the length of the rows. In other words, the LEDs 40 of the adjacent rows are not provided directly side-by-side, which can be seen in FIGS. 1, 2, 4, 6, and 8. The LEDs 40 are each positioned so that a central LED axis A (FIG. 2) thereof intersects a diffusing lens 30 that is provided across a light output opening 20 of the housing. The central LED axis A is the axis of the LED that extends away from and generally perpendicular to the surface on which the LED is mounted. In some embodiments the central LED axis A may substantially correspond to the center of the LED light output that is emitted by the LED. The LEDs 40 are each positioned so that if optics 50 were not present, some of the light output emitted by the LEDs 40 would be directly incident on the diffusing lens 30 without first being incident on one of the walls 23, 25, 27, and 29 or the LED support area 21.

In some embodiments, the LEDs 40 all emit white light. In some versions of those embodiments different LEDs 40 are configured to respectively generate different color temperatures of white light (e.g., some LEDs 40 emit light that is approximately 2700K, some LEDs 40 emit light that is approximately 3000K, and/or some LEDs 40 emit light that is approximately 3500K). In some embodiments different LEDs 40 are configured to respectively generate different spectrums of radiation. For example, in some embodiments the LEDs 40 may include multi-channel LEDs that emit two or more of Red, Blue, Green, Amber, and/or White. For example, in some embodiments the LEDs 40 may include five channels that generate red, green, blue, white 2700K, and white 4000K spectrums.

Figure 8:
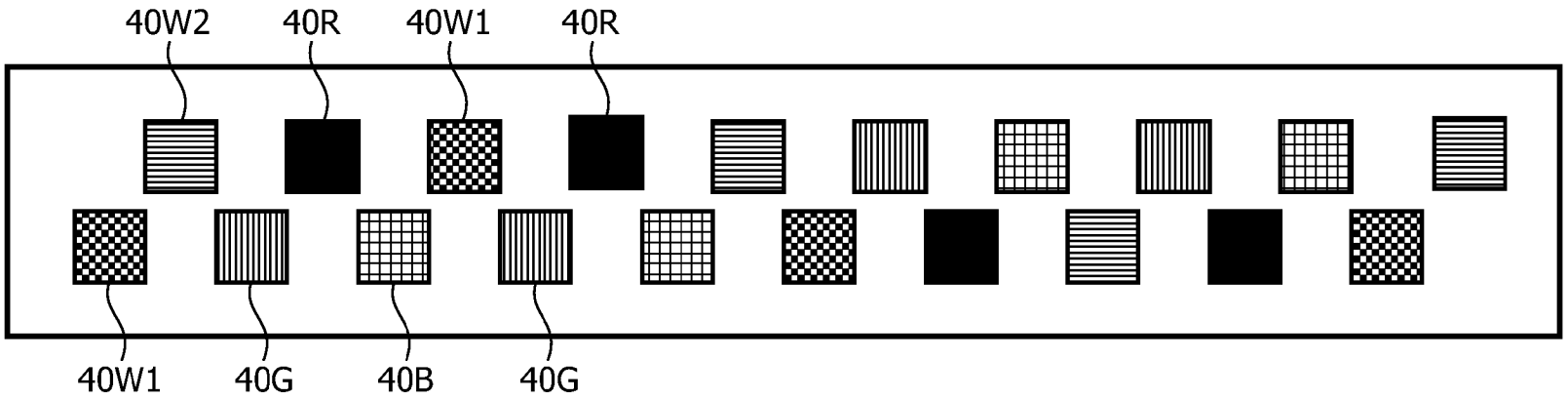
FIG. 8 illustrates a top view of an LED arrangement that may be implemented in the LED-based luminaire of FIG. 1.

FIG. 8 illustrates a top view of an LED arrangement that may be implemented in the LED-based luminaire 10. The LED arrangement includes four red LEDs 40R, four blue LEDs 40B, four green LEDs 40G, four white approximately 2700K LEDs 40W1, and four white approximately 4000K LEDs 40W2. Common shading of the LEDs references common colors (e.g., all red LEDs 40R have solid black shading). In the illustrated LED arrangement of FIG. 8 the red LEDs 40R are not provided at either end of the longitudinally extending rows of LEDs. Also, in the illustrated LED arrangement two LEDs of the same color are not provided most closely adjacent one another. That is, the closest LEDs in the same row, and the closest LEDs in the adjoining row for each LED of FIG. 8 is of a different color. For example, each red LED 40R is most closely adjacent a white approximately 2700K LED 40W1 and a white approximately 4000K LED 40W2 in the same row and is most closely adjacent an offset green LED 40G and offset blue LED 40B in the adjoining row.

The walls 23, 25, 27, and 29 surround the LEDs 40. Walls 23 and 25 extend substantially parallel with the two longitudinally extending rows of LEDs 40 and walls 27 and 29 extend between and are substantially perpendicular to the walls 23 and 25. In the illustrated embodiment the walls 27 and 29 taper outward slightly as they move from the LED support area 21 to the light output opening 20 as illustrated by viewing wall 29 in FIG. 5. Although certain walls forming an interior surface surrounding LEDs 40 are illustrated herein, one of ordinary skill in the art, having had the benefit of the present disclosure, will recognize and appreciate that in alternative embodiments alternative structure may be provided. For example, in some embodiments one or more of the walls may include interior facing surfaces that taper inwardly and/or outwardly. Also, for example, in some embodiments one or more of the walls may be non-planar. For example, in some embodiments a single arced wall may be provided that surrounds all of the LEDs. Also, for example, in some embodiments one or more of the walls may include multiple distinguishable surfaces.

At least the interior surfaces of the walls 23, 25, 27, and 29 are reflective. In some versions of those embodiments the interior surfaces are diffusely reflective. In some embodiments the interior surfaces are formed of textured highly reflective material to provide for diffuse reflection. In some embodiments the interior surfaces may include a microfoamed polyethylene terephthalate (MCPET) sheet to provide for diffuse reflection. In some embodiments coatings and/or materials may be utilized that provide from approximately 85% to approximately 95% reflectivity. In some embodiments the LED support area 21 may also be reflective. For example, the interior surface of the LED support area 21 may be diffusely reflective. One of ordinary skill in the art, having had the benefit of the present disclosure, will recognize and appreciate that various coatings and/or materials may be utilized to achieve diffuse reflection on one or more interior surfaces of the LED-based luminaire 10.

The diffusing lens 30 is provided over the light output opening 20 and transmits and diffuses light emitted from the LEDs 40 therethrough. The diffusing lens 30 may utilize, for example, texturing and/or volumetric diffusion to achieve diffusion of the light transmitted therethrough. In some embodiments the diffusing lens 30 may also shape the light output emitted from the LEDs 40 as it passes therethrough. For example, the diffusing lens 30 may shorten and/or lengthen the light output in one or more light distribution axes to create desired beam patterns. In some specific embodiments the diffusing lens 30 may be a MAKROLON Lumen XT light diffusing sheet available from Bayer MaterialScience of Sheffield, Mass. In some other specific embodiments the diffusing lens 30 may be a lens utilizing MESOOPTICS technology available from Philips Ledalite of Langley, British Columbia. Although a single longitudinally extending cover lens 30 atop the housing is illustrated herein, one of ordinary skill in the art, having had the benefit of the present disclosure, will recognize and appreciate that in alternative embodiments other configurations and/or placements of cover lens 30 may be utilized. For example, in some embodiments the cover lens 30 may include multiple pieces, may be non-rectangular, may be shaped differently than the light output opening, and/or may be positionally mounted at other locations (e.g., closer to the LEDs 40).

Light output generated by each of the LEDs 40 is directed through a respective optic 50 to one or more of the interior surfaces of structures 21, 23, 25, 27, and 29, where it is diffusely reflected one or more times prior to exiting the housing through the diffusing lens 30. Each of the optics 50 is positioned and configured to redirect at least substantially all of the light from a respective of LEDs 40 that would be directly incident on the diffusing lens 30 if the optic 50 was not provided. Accordingly, in the lighting fixture 10, substantially no light output from LEDs 40 is directly incident on diffusing lens 30. Rather, in the lighting fixture 10, substantially all light output from the LEDs 40 is first reflected off at least one of interior surfaces of structures 21, 23, 25, 27, and 29 prior to being incident on the diffusing lens 30.

Figure 3:
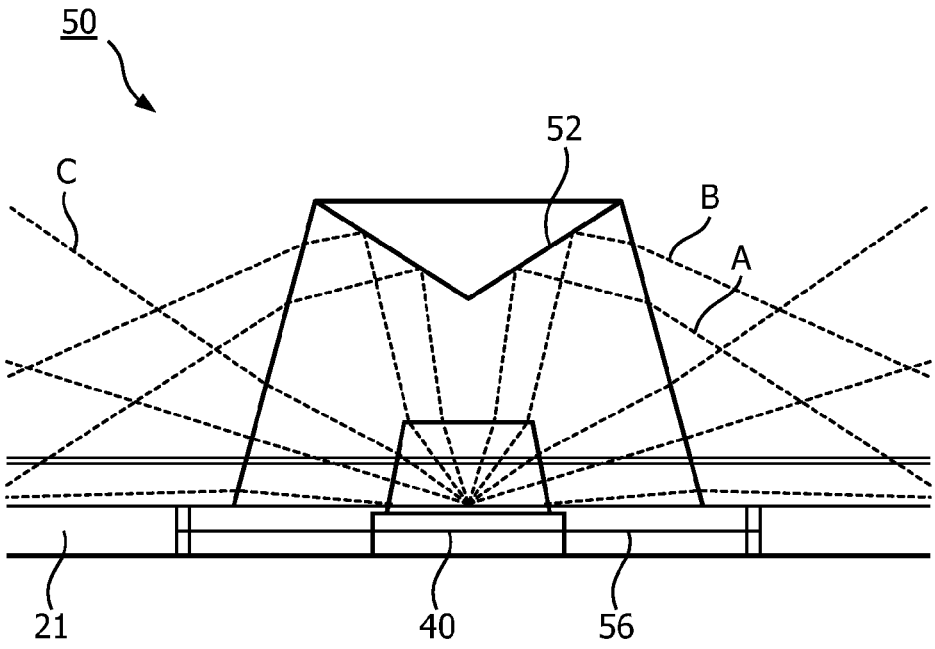
FIG. 3 illustrates a section view of a single LED and single optic of the LED-based luminaire of FIG. 1; a ray trace of some of the light output emitted by the LED is also illustrated.

Referring to FIG. 3, one of the optics 50 is illustrated in additional detail along with a ray trace of some of the light output emitted by the respective LED 40. The illustrated optics 50 are side emitting TIR optics and include a base 56 surrounding the base of the LED 40. In some embodiments the optics 50 may be F360L-3-RE-0R side emitter lenses available from FRAEN Corporation of Reading, Mass. In alternative embodiments other optics may be utilized that redirect at least substantially all of the light from a respective of LEDs 40 that would be directly incident on the diffusing lens 30 if the optic was not provided. For example, in alternative embodiments a reverse reflector optic may be utilized, a non-360° side emitting optic (e.g., a 180° side emitting optic), an optic that is provided over more than one LED, and/or a non-TIR optic.

The optics 50 include a 360° emitting TIR region 52 at the top of the optic that is angled to satisfy TIR and totally internally reflect substantially all light output from LED 40 incident thereon such as light rays A and B. Light ray A is reflected by TIR region 52 and directed out of the optic 50 toward LED support area 21, where it is again reflected and directed toward one of the walls 23, 25, 27, 29 extending upward from the LED support area 21. Light ray B is reflected by TIR region 52 and directed out of the optic 50 either toward LED support area 21 or one of the walls 23, 25, 27, 29 extending upward from the LED support area 21. Other light rays, such as light ray C are directed through and optionally refracted by the optic 50 toward one of the walls extending upward from the LED support area 21. In some embodiments substantially all light output that would be directly incident on diffusing lens 30 if optic 50 were not present is directly incident on TIR region 52 and reflected thereby.

Figure 4:
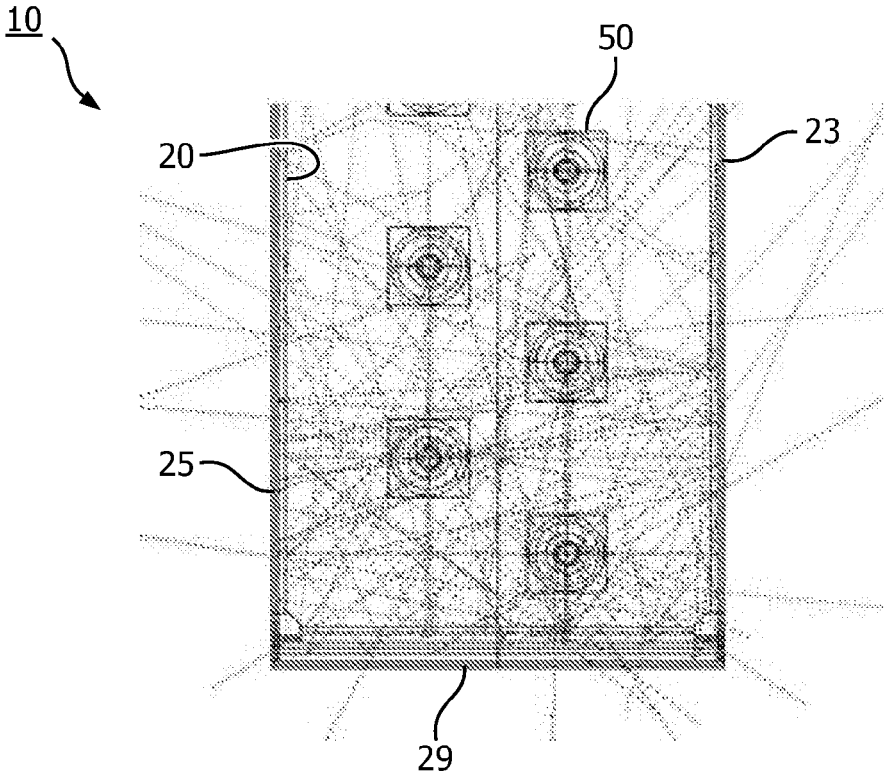
FIG. 4 illustrates a top view of the LED-based luminaire of FIG. 1 with a diffusing cover lens of the LED-based luminaire removed; a ray trace of some of the light output emitted by some of the LEDs of the LED-based luminaire is also illustrated.
Figure 5:
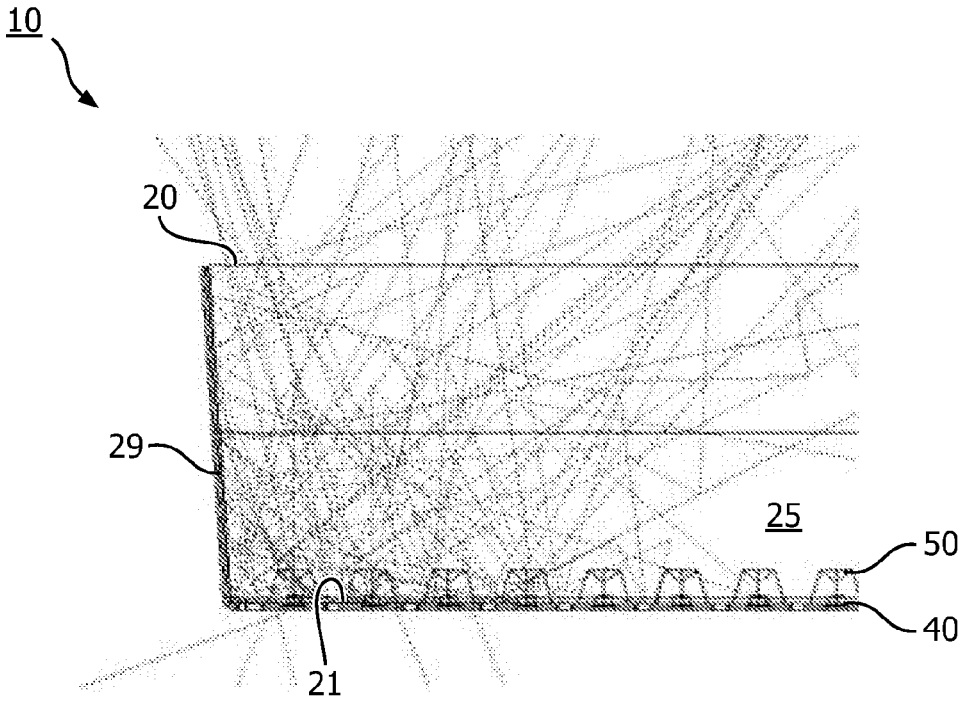
FIG. 5 illustrates a side view of the LED-based luminaire of FIG. 1 with a diffusing cover lens of the LED-based luminaire removed; a ray trace of some of the light output emitted by some of the LEDs of the LED-based luminaire is also illustrated.
Figure 6:
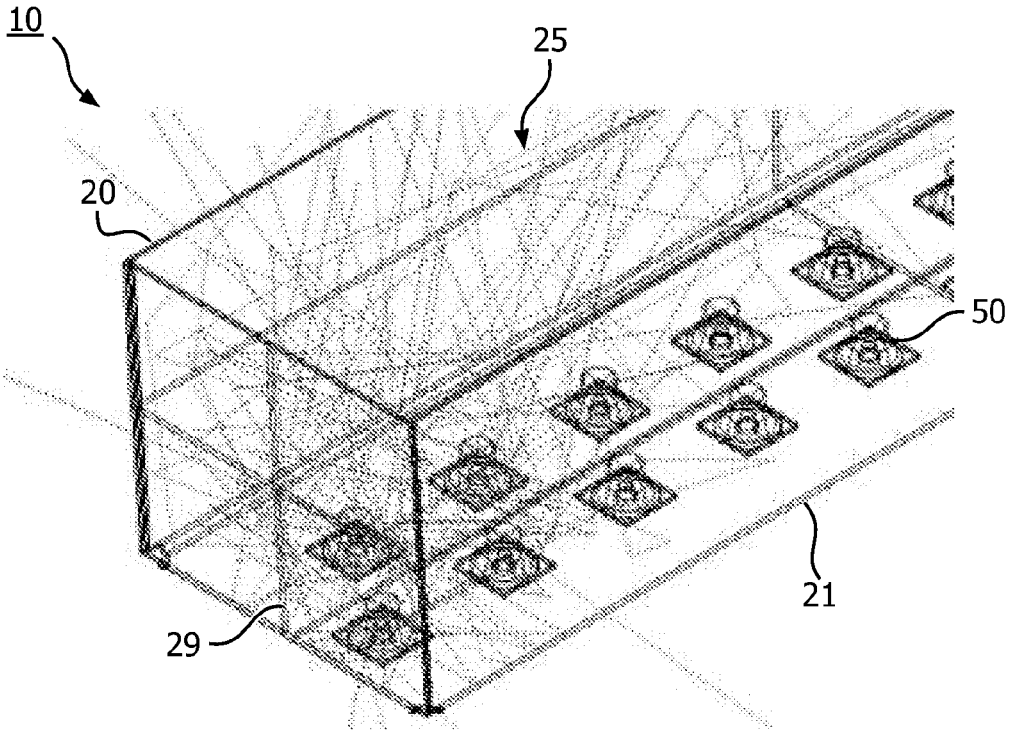
FIG. 6 illustrates a perspective view of the LED-based luminaire of FIG. 1 with a diffusing cover lens of the LED-based luminaire removed and a housing of the LED-based luminaire illustrated as semi-transparent; a ray trace of some of the light output emitted by some of the LEDs is also illustrated.
Figure 7:
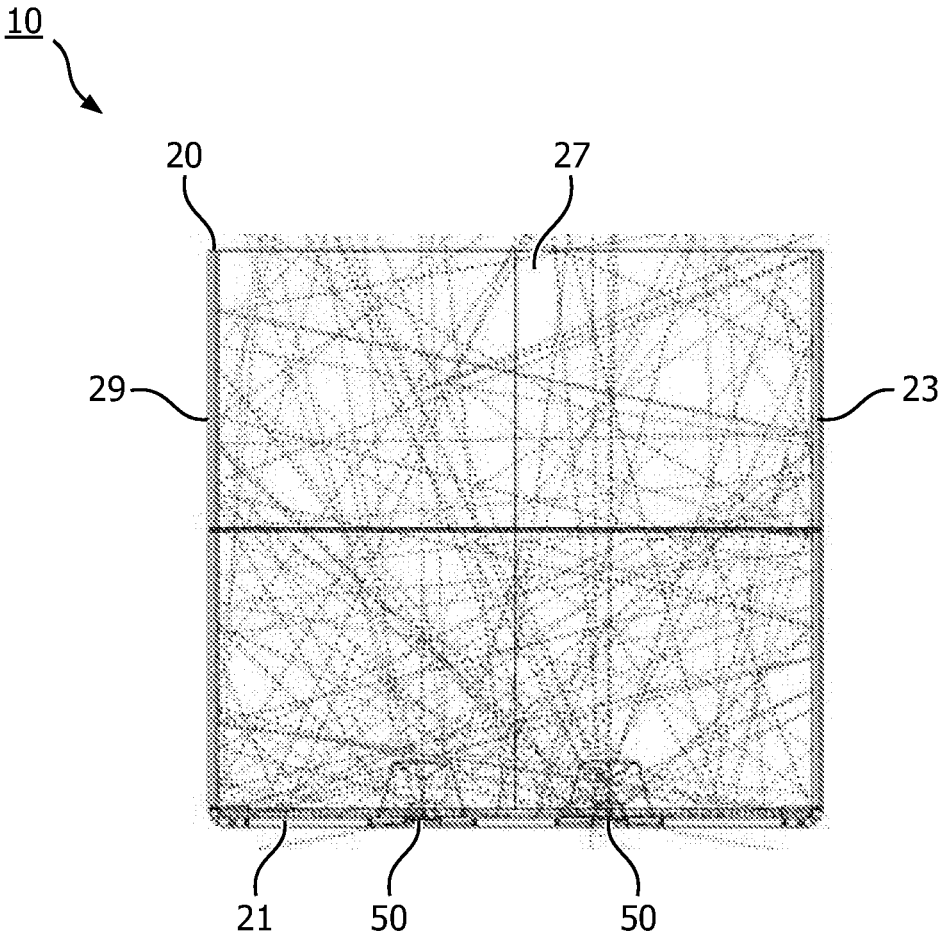
FIG. 7 illustrates a front section view of the LED-based luminaire of FIG. 1 with a diffusing cover lens of the LED-based luminaire removed; a ray trace of some of the light output emitted by some of the LEDs is also illustrated.

Referring now to FIGS. 4-7, various views of the LED-based luminaire 10 are presented, each with a ray trace of some of the light output emitted by one or more of the LEDs 40 visible therein. FIG. 4 illustrates a top view of the LED-based luminaire 10 with the diffusing cover lens 30 removed. In FIG. 4 it can be seen that some of the light output that is generated by LEDs 40 is directed through optics 50 to the interior surfaces of walls 23, 25, and 29, where it is diffusely reflected either back to other interior structure or out through light output opening 20 (as illustrated by some of the light rays exiting the lighting fixture 10). FIG. 5 illustrates a side view of the LED-based luminaire 10 with the diffusing cover lens 30 removed. In FIG. 5 it can be seen that some of the light output that is generated by LEDs 40 is directed through optics 50 to the interior surface of walls 25, and 29 and the interior surface of LED support area 21 where it is diffusely reflected either back to other interior structure or out through light output opening 20 (as illustrated by some of the light rays exiting the lighting fixture 10). FIG. 6 illustrates a perspective view of the LED-based luminaire 10 with the diffusing cover lens 30 removed and the housing of the LED-based luminaire 10 illustrated as semi-transparent. In FIG. 6 the emission of the light from the optics 50 and the various diffuse reflections of interior structures can also be seen. FIG. 7 illustrates a front section view of the LED-based luminaire of FIG. 1 with diffusing cover lens 30 removed. In FIG. 7 the emission of the light output from two LEDs 40 through two optics 50 and the diffuse reflections thereof by interior surfaces of walls 23, 25 and LED support area 21 are illustrated.

The lighting fixture 10 may be a direct view lighting fixture and the diffusing lens 30 may form the exterior directly viewable lens of the lighting fixture. In some versions of those embodiments the direct view lighting fixture may be a recessed linear direct view lighting fixture.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing in the claims in parentheses, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A LED lighting fixture, comprising:

a housing having a light output opening, a LED support area facing said light output opening, and a plurality of diffusely reflective walls extending between said LED support area and said light output opening;

a plurality of LEDs adjacent said LED support area, each of said LEDs selectively generating a LED light output having a component emitting directly toward said light output opening;

said LEDs including a first longitudinally extending row of LEDs and a second longitudinally extending row of LEDs in parallel relation to said first longitudinally extending row of LEDs, wherein said LEDs of said first longitudinally extending row of LEDs are positionally offset from said LEDs of said second longitudinally extending row of LEDs in a direction along the length of said first and second longitudinally extending rows;

a plurality of blocking optics, each of said blocking optics provided over a different, respective LED of said plurality of LEDs and below said output opening and redirecting at least said component of said LED light output of said respective LED toward at least one of said diffusely reflective walls, wherein at least one blocking optic of said plurality of blocking optics is configured to direct at least one other light component, of said LED light output of said respective LED, above an upper extent of said at least one blocking optic as said at least one other light component exits through a lateral surface of said at least one blocking optic; and a diffusing cover lens provided across said light output opening.

2. The LED lighting fixture of claim 1, wherein said diffusely reflective walls are rectangularly arranged.

3. The LED lighting fixture of claim 1, wherein said LED support area is planar.

4. The LED lighting fixture of claim 3, wherein said diffusely reflective walls are rectangularly arranged.

5. The LED lighting fixture of claim 4, wherein said diffusing cover lens is provided atop said diffusely reflective walls.

6. The LED lighting fixture of claim 1, wherein said LED support area includes a plurality of openings receiving said LEDs therethrough.

7. The LED lighting fixture of claim 1, wherein said blocking optics include side emitting optics.

8. The LED lighting fixture of claim 1, wherein said light output opening is rectangular.

9. The LED lighting fixture of claim 1, wherein said LED support area is diffusely reflective.

10. A LED lighting fixture, comprising:

a housing having a LED support area, a diffusely reflective interior surface extending upward from and surrounding said LED support area, and a light output opening;

a plurality of LEDs adjacent said LED support area, said LEDs selectively generating a LED light output having a component emitting directly toward said light output opening;

said LEDs including at least two longitudinally extending rows of LEDs;

wherein, for each LED of said longitudinally extending rows of LEDs, the LED is configured to produce a color that is unique from any immediately preceding LED and unique from any immediately following LED of the longitudinally extending row to which the LED belongs; and the color of the LED is unique from the most closely adjacent LED of the longitudinally extending row to which the LED does not belong;

a plurality of blocking optics, each of said blocking optics provided over a different, respective LED of said plurality of LEDs and below said light output opening and redirecting at least said component of said LED light output of said respective LED toward said diffusely reflective interior surface, wherein at least one blocking optic of said plurality of blocking optics is configured to direct at least one other light component, of said LED light output of said respective LED, above an upper extent of said at least one blocking optic as said at least one other light component exits through a lateral surface of said at least one blocking optic; and a diffusing cover lens provided across said light output opening.

11. The LED lighting fixture of claim 10, wherein said diffusely reflective interior surface includes a plurality of rectangularly arranged walls.

12. The LED lighting fixture of claim 11, wherein said LED support area is planar.

13. The LED lighting fixture of claim 12, wherein said LED support area is provided at a base of said diffusely reflective interior surface.

14. The LED lighting fixture of claim 10, wherein said blocking optics include at least one individual optic provided over a single of said LEDs.

15. The LED lighting fixture of claim 10, wherein said diffusing cover lens is provided atop said diffusely reflective interior surface.

16. The LED lighting fixture of claim 10, wherein said LEDs include LEDs of a third color and LEDs of a fourth color.

17. A LED lighting fixture, comprising:

a housing having a light output opening, a LED support area facing said light output opening, and at least one diffusely reflective wall extending between said LED support area and said light output opening;

a plurality of LEDs adjacent said LED support area, each of said LEDs selectively generating a LED light output having a component emitting directly toward said light output opening;

a plurality of blocking optics, each of said blocking optics provided over a different, respective LED of said plurality of LEDs and below said output opening and redirecting at least said component of said LED light output of said respective LED toward said at least one diffusely reflective wall, wherein at least one blocking optic of said plurality of blocking optics is configured to direct at least one other light component, of said LED light output of said respective LED, above an upper extent of said at least one blocking optic as said at least one other light component exits through a lateral surface of said at least one blocking optic; and a diffusing cover lens provided across said light output opening.

18. The LED lighting fixture of claim 17, wherein said at least one blocking optic is configured to upwardly direct a majority of said LED light output directly impinging on said lateral surface from said respective LED.

19. The LED lighting fixture of claim 1, wherein said at least one blocking optic is configured to upwardly direct a majority of said LED light output directly impinging on said lateral surface from said respective LED.

20. The LED lighting fixture of claim 10, wherein said at least one blocking optic is configured to upwardly direct a majority of said LED light output directly impinging on said lateral surface from said respective LED.

* * * * *